US005809983A

United States Patent [19]

Stoneking

[11] Patent Number: 5,809,983

[45] Date of Patent: Sep. 22, 1998

[54] LIGHTING LOADER SYSTEM

[76] Inventor: Scot E. Stoneking, 5632 Butterbridge Rd., Canal Fulton, Ohio 44614

[21] Appl. No.: 758,388

[22] Filed: Nov. 29, 1996

[51] Int. Cl.[6] ..... F41A 9/61

[52] U.S. Cl. ..... 124/50; 124/45

[58] Field of Search ..... 124/49, 47, 45, 124/50, 82, 56; 141/364, 386

[56] References Cited

U.S. PATENT DOCUMENTS

| | | | |
|---|---|---|---|
| 3,263,664 | 8/1966 | Bauer et al. | 124/49 |
| 4,937,628 | 6/1990 | Cipolla et al. | 141/364 X |
| 5,166,457 | 11/1992 | Lorenzetti | 124/49 X |
| 5,174,807 | 12/1992 | MacDonald | 124/72 X |
| 5,257,615 | 11/1993 | Jones | 124/56 |
| 5,282,454 | 2/1994 | Bell et al. | 124/56 X |
| 5,361,746 | 11/1994 | Szente | 124/49 X |
| 5,383,422 | 1/1995 | Tippmann | 124/73 X |

*Primary Examiner*—Tamara L. Graysay
*Assistant Examiner*—Thomas A. Beach
*Attorney, Agent, or Firm*—Sand & Sebolt; John Vasuta

[57] ABSTRACT

The improved paintball loader and hopper is designed to allow a paintball player to load up to one hundred paintballs in just a few seconds without opening or closing the hopper or speed loader tube separately. After fitting the paintball gun with the improved hopper, the improved loader is then lined up with the rails on the hopper and pushed forward to engage the stop on the hopper which opens the loader gate as the loader is pushed forward. At the same time, the loader rails engage the hopper gate and push it open beneath the loader's open gate. The paintballs in the loader fall into the hopper and the loader is pulled back and disengaged from the hopper which allows the rubber bands on the gates to pull the gates into the closed position.

20 Claims, 10 Drawing Sheets

40
41
42
43
44
45
46
47
48
49
49a
49b

B

39

53
60
61

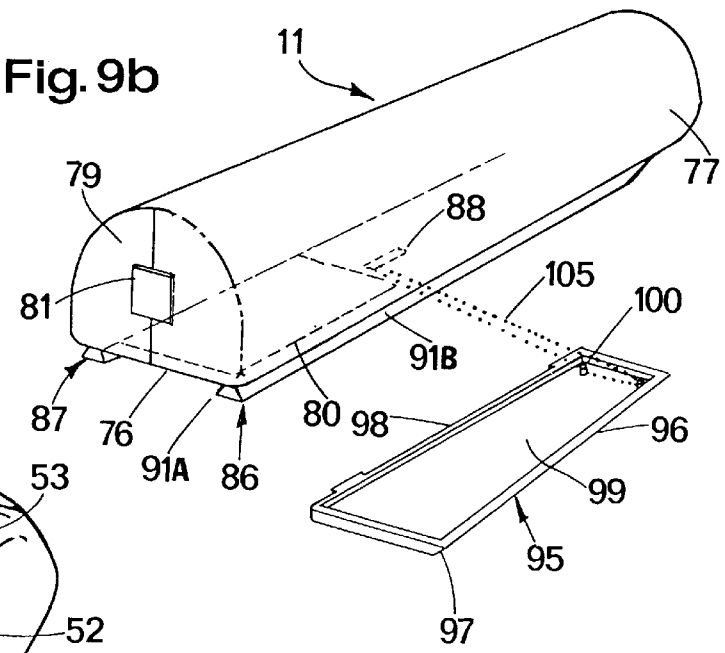
Fig. 9b
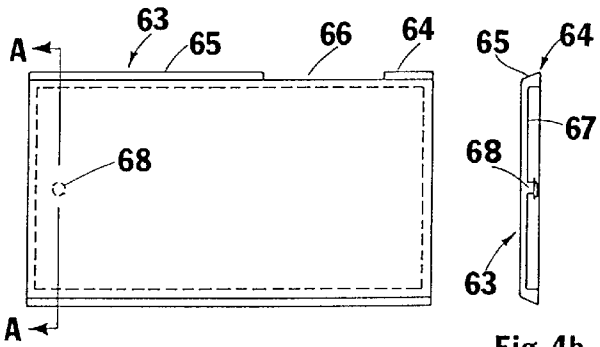
Fig. 4b
Fig. 4
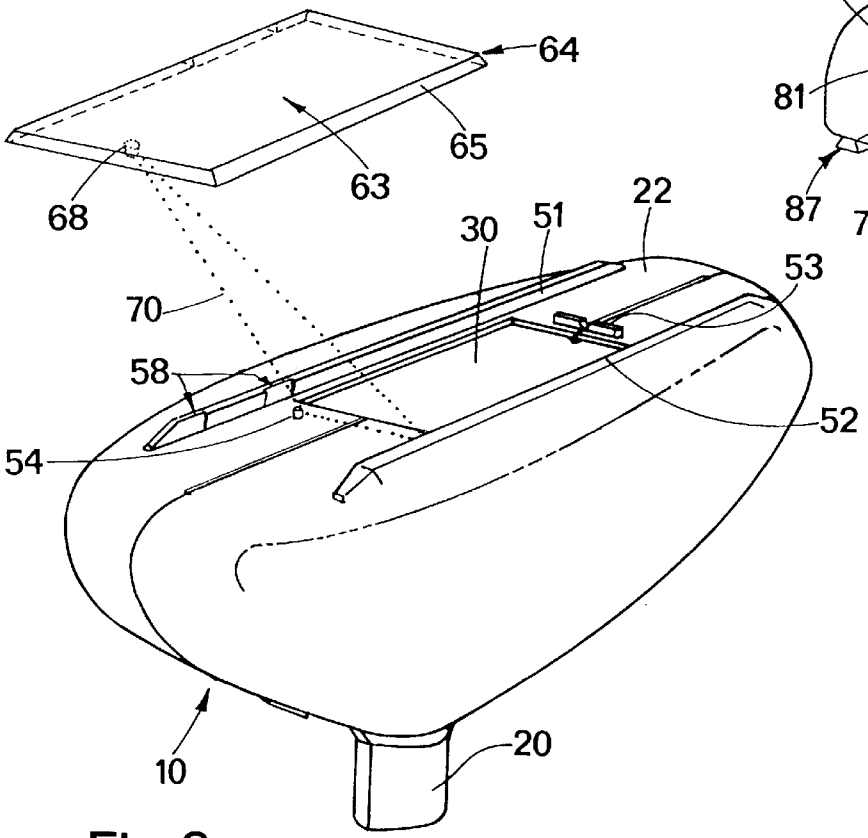
Fig. 9a

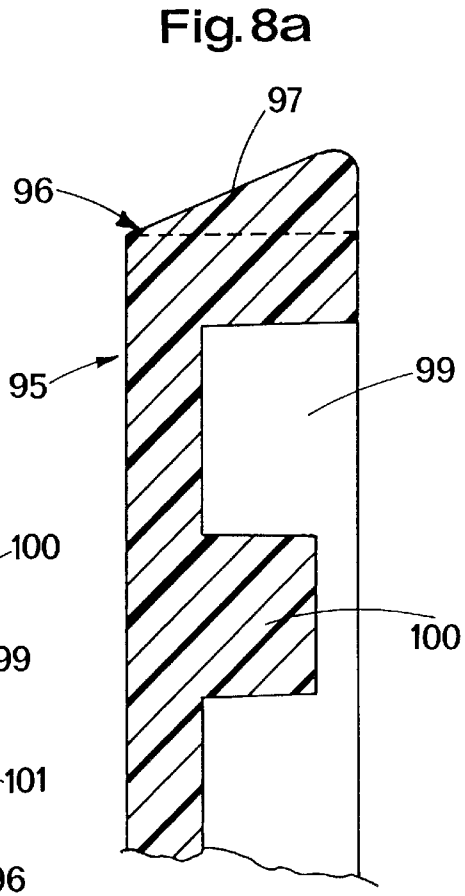
Fig. 8a
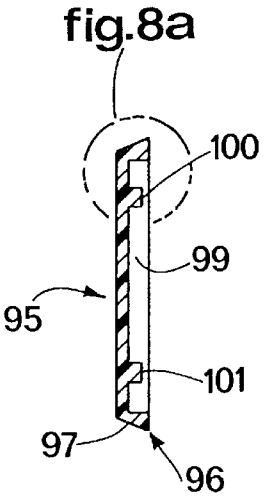
fig. 8a
Fig. 8d
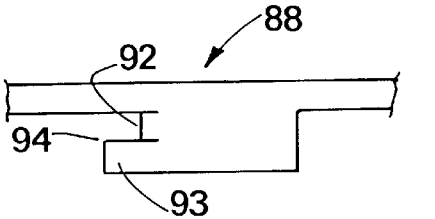
Fig. 8b
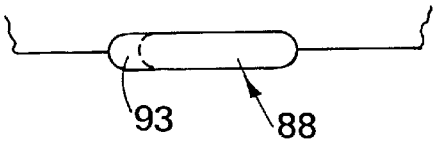
Fig. 8c
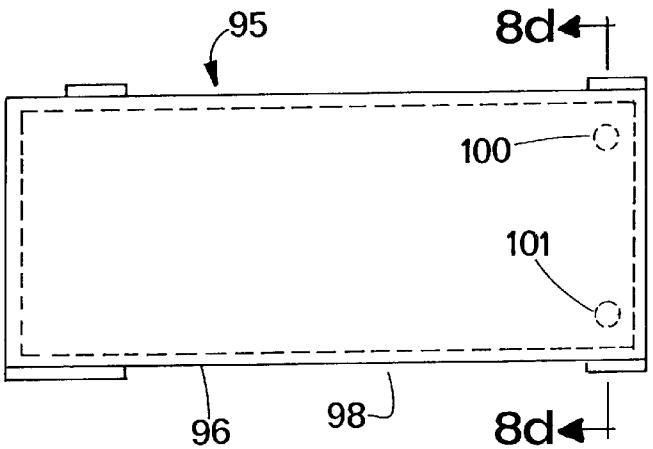
Fig. 8

LIGHTING LOADER SYSTEM

THE BACKGROUND OF THE INVENTION

1. The Field of the Invention

The improved paintball loader and hopper is an invention for use in the sport of paintball. Paintball is a sport where individuals and teams participate in action pursuit games. The objectives vary from 'capture the flag' scenarios to 'attack and defend' and military/law enforcement training. The sport is enjoyed by more than one million players worldwide with the bulk of them in the United States. The paintballs are normally 0.68 cal and are $CO_2$ propelled from a gun specifically designed for paintballs. The invention is an improved paintball loader with a door therein that interacts with an improved hopper for receiving the loader. Specifically, the invention is an improved paintball loader with a door therein and an improved hopper with another door therein where when the loader engages the hopper an open mouth is defined as the doors are simultaneously opened as the loader is slidably engaged onto the hopper thereby allowing the paintballs in the loader to gravitationally drop or roll into the hopper through the open mouth between the loader and hopper and where the loader is slidably disengaged from the hopper the doors simultaneously close thereby closing the mouth.

2. Description of the Related Art

The minimum basic equipment for a paintball player consists of (1) a paintball gun fitted with a hopper that supplies the paintballs to the gun much like a magazine holds ammunition in a standard firearm, (2) a loader which is used to store extra paintballs and refill the hopper as necessary, (3) a $CO_2$ supply or other propellant and (4) specially designed eye protection.

An example of a prior art paintball gun is found in U.S. Pat. No. 5,282,454 where a paintball gun (12) is shown with a hopper (10) referred to as a bulk loader attached thereto. A $CO_2$ cannister (22) is also provided. The rear end of the hopper (10) includes a cap (40) hingedly connected to the hopper whereby the cap is pivotable to an open position to permit more paintballs to be loaded into the hopper (10).

To the extent of Applicant's knowledge, all of the hoppers and loaders currently being used in the sport are designed with a 'flip-top' style opening (like that described above for U.S. Pat. No. 5,282,454) or a similar design that requires the player to open and close the devices separately. Even professional players have difficulty opening and closing the equipment when they need to reload quickly under pressure from advancing opponents. The 'flip-top' lids on existing equipment are often difficult to close completely during the fast paced action of the game. This often results in lost ammunition and valuable time. The lids are also noisy and the opposing team often knows exactly when a player is reloading even if he is not in view. There is a detailed description of the comparisons of the reloading process in the next section below.

A SUMMARY OF THE INVENTION

Applicant saw the need for a system that saves time and effort while making it easier to reload without fumbling or spilling ammunition in the field. As a result, Applicant invented a system that consists of a hopper and a loader which opens automatically when they engage one another and closes automatically when they disengage, thus greatly reducing the time spent on reloading with no spilling of paintballs (since the doors of the loader and hopper are only open when the loader and hopper are engaged to one another with a closed passage or mouth therebetween) or fumbling with caps, lids, and other parts during play.

Here is a chronological description of the reloading process using existing equipment. When the player is out of paintballs in the hopper on his gun that player must reload using a loader tube or similar device that contains a supply of paintballs. Specifically, the player must perform the following steps:

1. Open the hopper lid on the player's paintball gun.
2. Remove the loader tube from its holder (usually in a pack that holds the tubes in with a Velcro flap).
3. Open the loader tube (take off a cap or lid).
4. Dump the paintballs into the hopper mouth.
5. Close the cap or lid on the loader tube.
6. Return the loader tube to its pack and secure it with the Velcro flap.
7. Close the hopper lid.
8. Return fire.

Now here is the chronological description of the reloading process using the improved loader and hopper system of the present invention.

1. Remove the speed loader from its pack after pulling up the Velcro flap.
2. Line up the 'rails' on the speed loader with the 'rails' on the hopper and slide the speed loader forward until it stops. It is possible to return fire at this point because the speed loader is engaged and 'locked on' to the hopper as the paintballs drop into the gun and will not fall off without being pulled back. The player can shoot immediately if necessary and remove the speed loader at a more convenient time.
3. Pull the speed loader back and off the hopper and return it to its pack and secure it with the Velcro flap.
4. Return fire.

Another unique and valuable feature of this system is the ability to open the components in the field without the use of tools. All the other hoppers and loaders are either one piece construction or screwed together which makes it very difficult, if not impossible, to clean out broken paintballs in the field. This cleaning is necessary and absolutely essential because if one of the paintballs in the hopper or loader is broken it will contaminate the others and adversely affect the trajectory of the paintball when it leaves the end of the barrel. With the improved loader and hopper of the present invention a player can detect a broken paintball problem and dump the contaminated paintballs out of the hopper or speed loader, clean the inside, reload and return fire.

A BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

FIG. 1 is a side elevation of the hopper of the present invention with the hopper gate not shown and with hidden parts shown in hidden lines;

FIG. 1*a* is an enlarged fragmentary sectional view of the field snap and hook of the hopper of FIG. 1;

FIG. 1*b* is an enlarged fragmentary detail view of the edge joint of the hopper of FIG. 1 FIG. 1*c* is an enlarged fragmentary detail view of the assembly hinge of the hopper of FIG. 1;

FIG. 2 is a rear sectional view of the hopper of FIG. 1;

FIG. 2*a* is an enlarged fragmentary detail view of the gate stop of FIG. 2;

Figure 1:
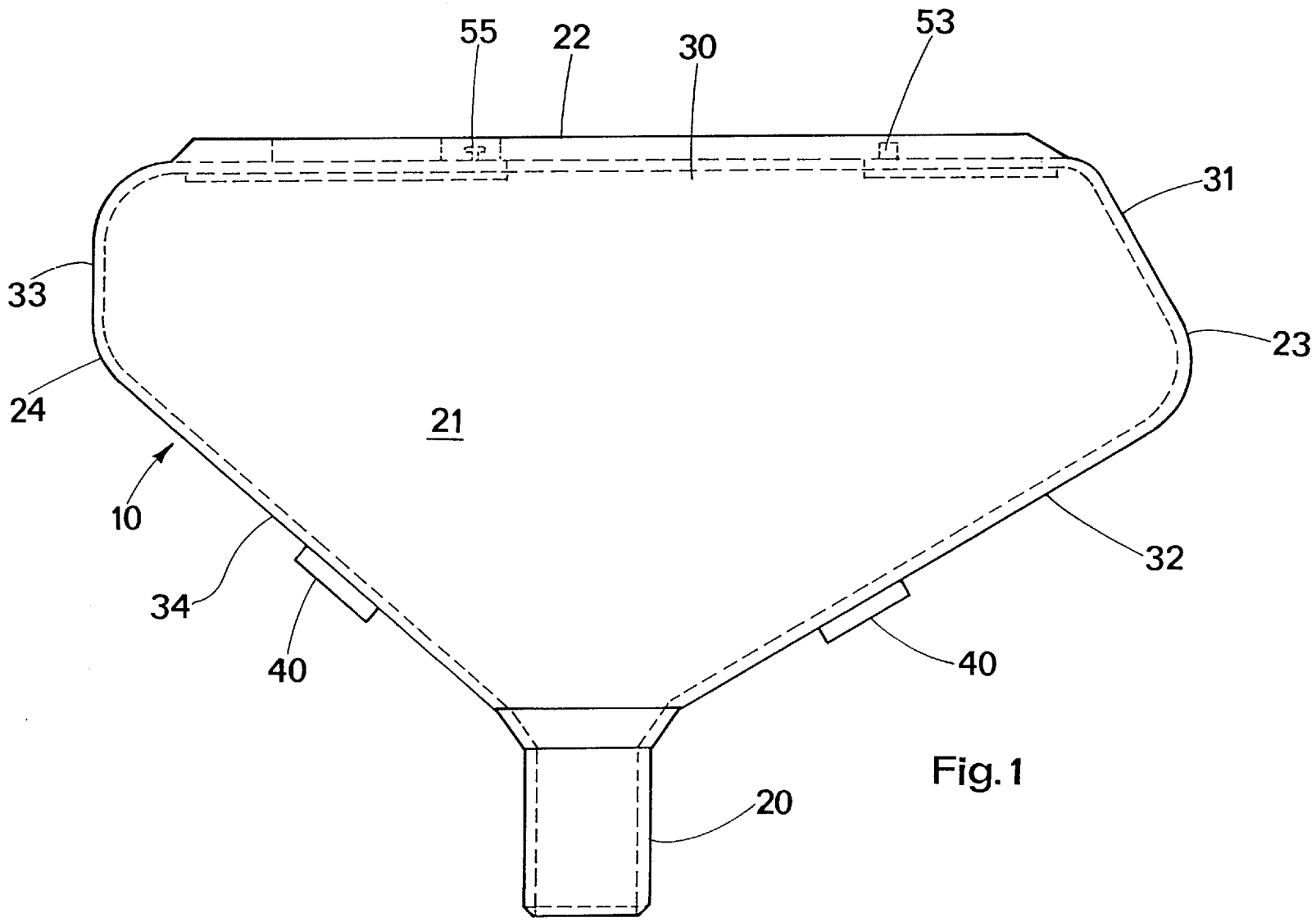
Figures 1A, 1B, 1C, 2A, 4A:
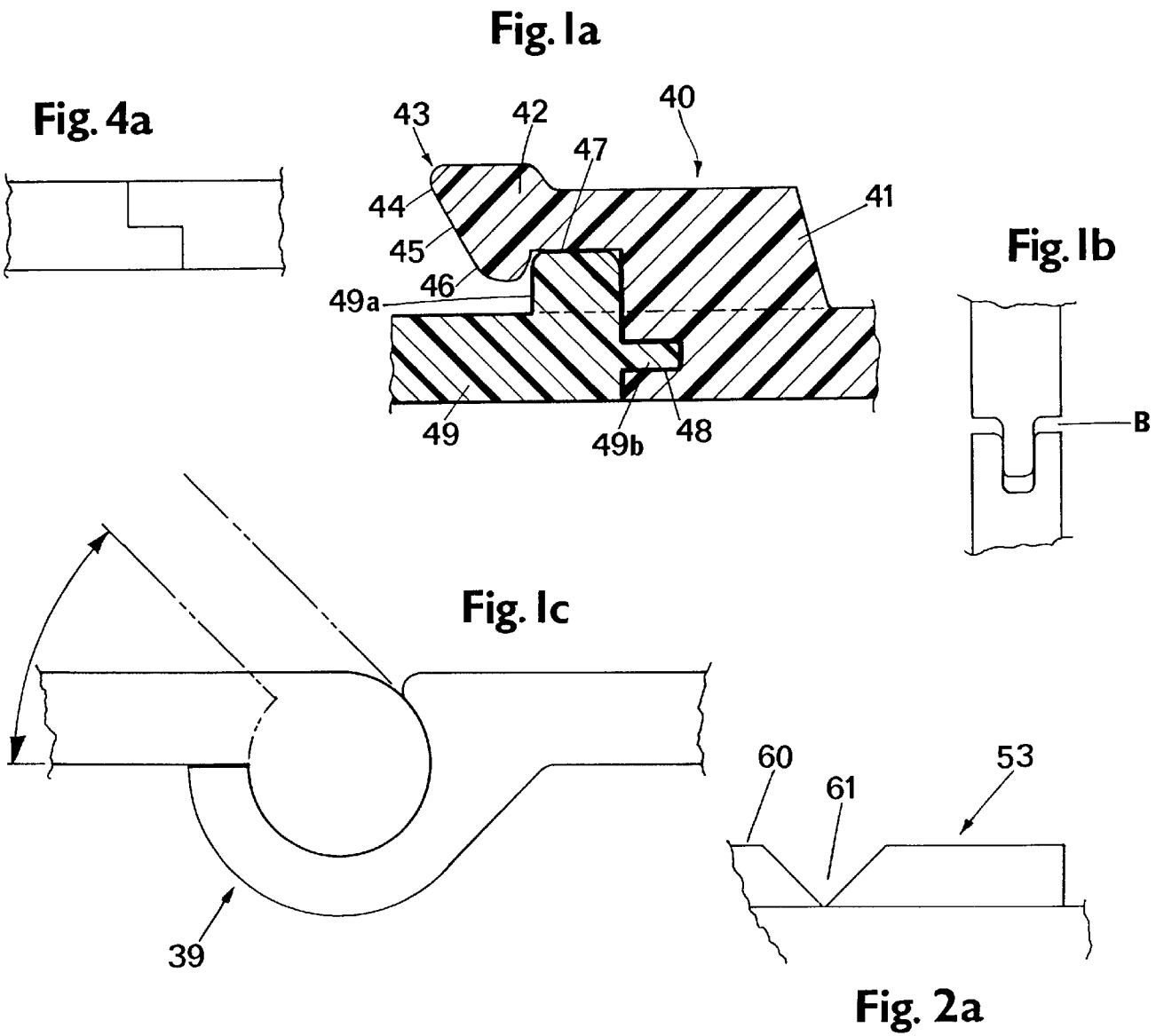
FIG. 4 is a top plan view of the hopper gate with internal parts shown in hidden lines.
Figure 7:
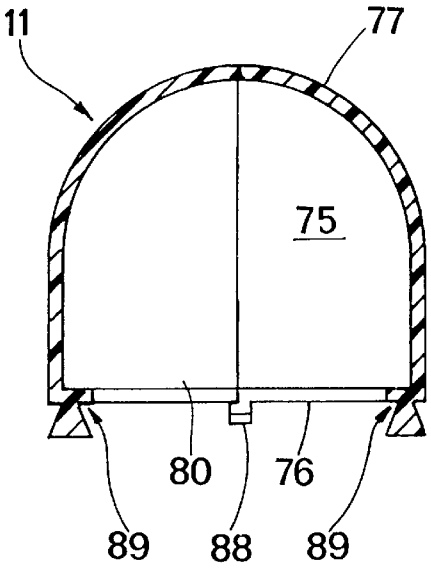
Figure 5:
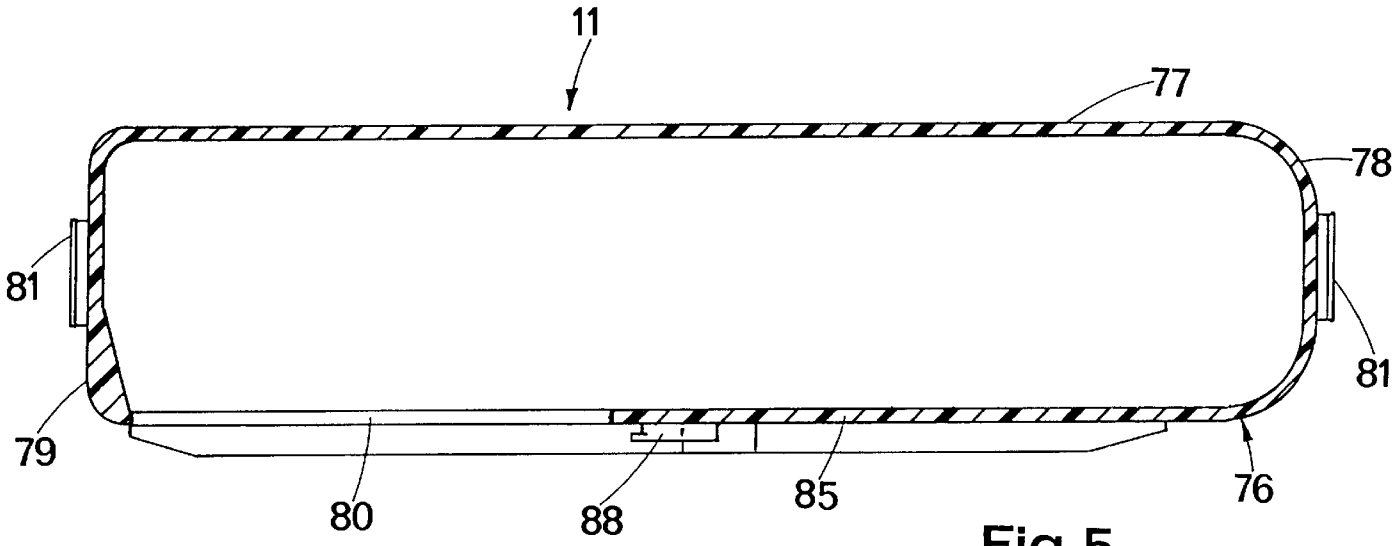
Figure 6:
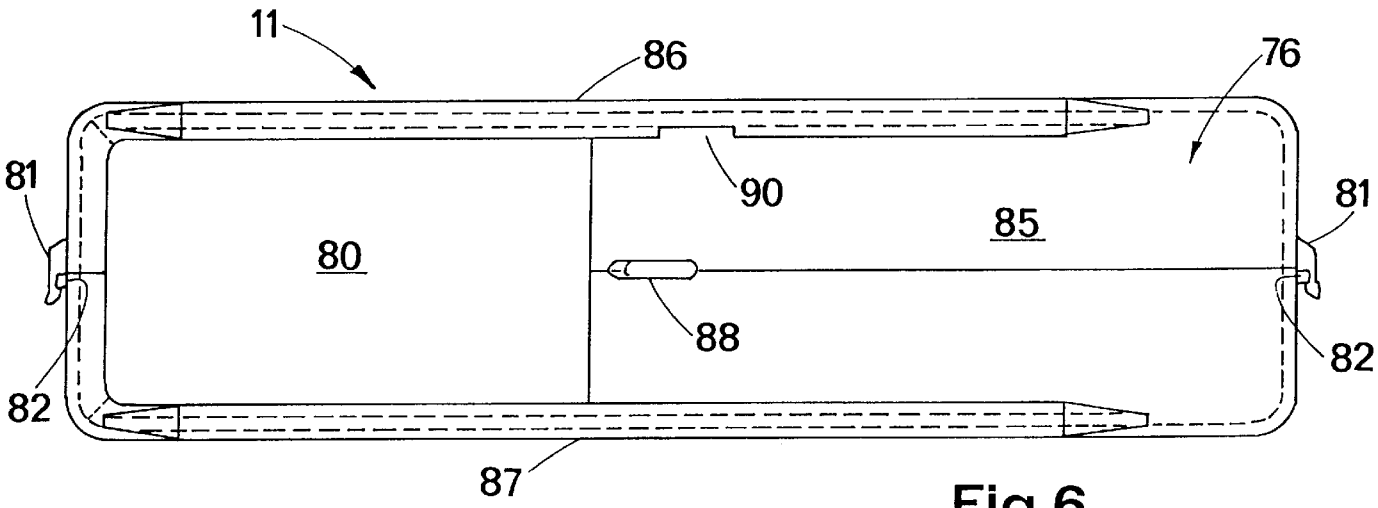

FIG. 4*a* is an enlarged fragmentary detail view of the hinge area joint of the present invention;

FIG. 4*b* is a sectional view of the hopper gate of FIG. 4 taken along line A—A in FIG. 4;

FIG. 5 is a side sectional view of the loader of the present invention with the loader gate not shown;

FIG. 6 is a bottom elevation view of the loader of FIG. 5 with the loader gate not shown and with hidden parts shown in hidden lines;

FIG. 7 is an end sectional view of the loader of FIG. 5 with the loader gate not shown;

FIG. 8 is a bottom plan view of the loader gate with hidden parts shown in hidden lines;

FIG. 8*a* is an enlarged fragmentary sectional view of one rail receiving portion of the loader gate as taken from FIG. 8*d;*

FIG. 8*b* is an enlarged fragmentary detail view of the gate stop on the loader of FIG. 5 taken from a side perspective;

FIG. 8*c* is an enlarged fragmentary detail view of the gate stop of FIG. 8*b* taken from a bottom perspective;

FIG. 8*d* is a sectional view of the loader gate of FIG. 8 taken along lines 8*d*—8*d;*

Figure 10:
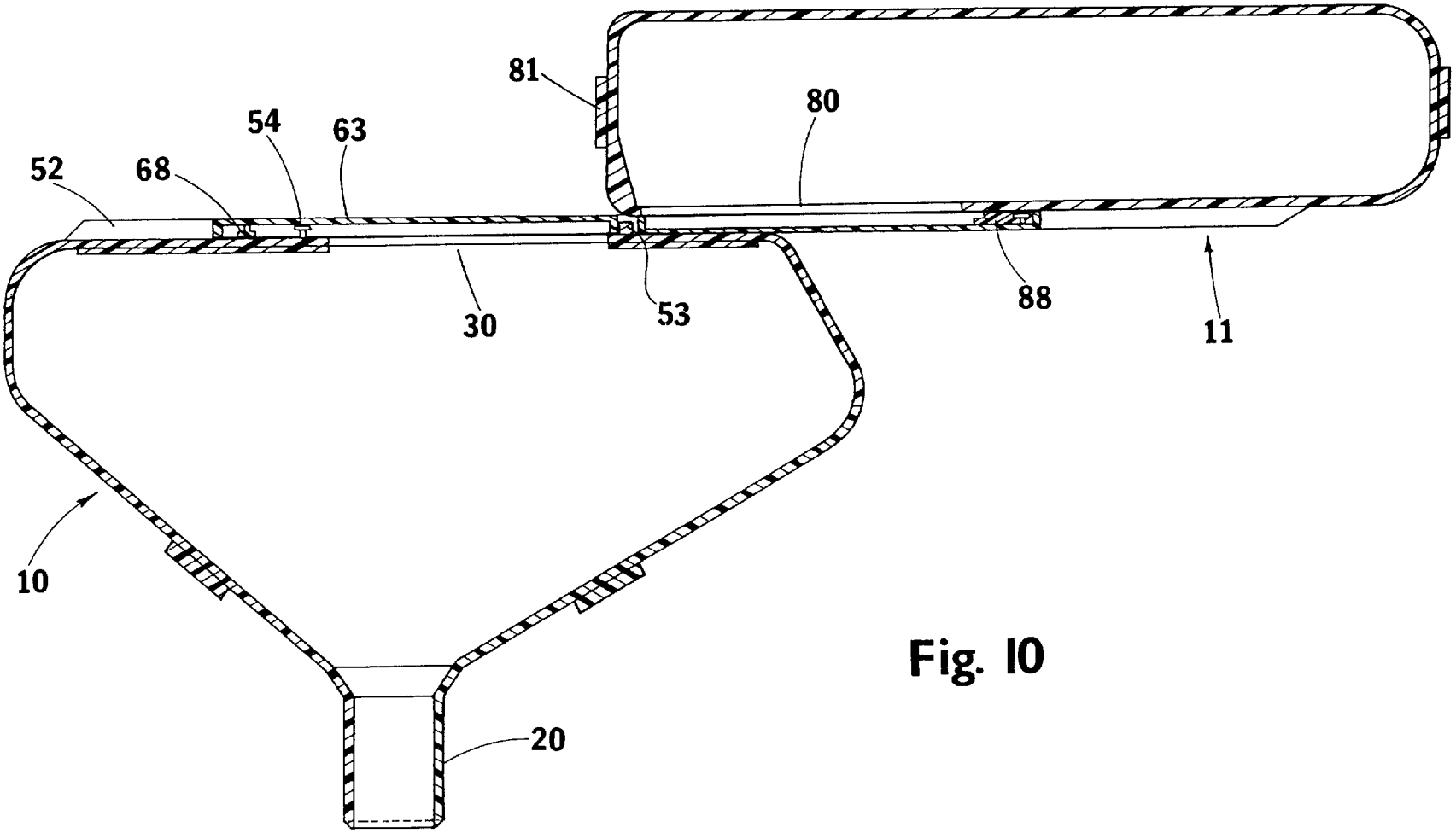
Figure 11:
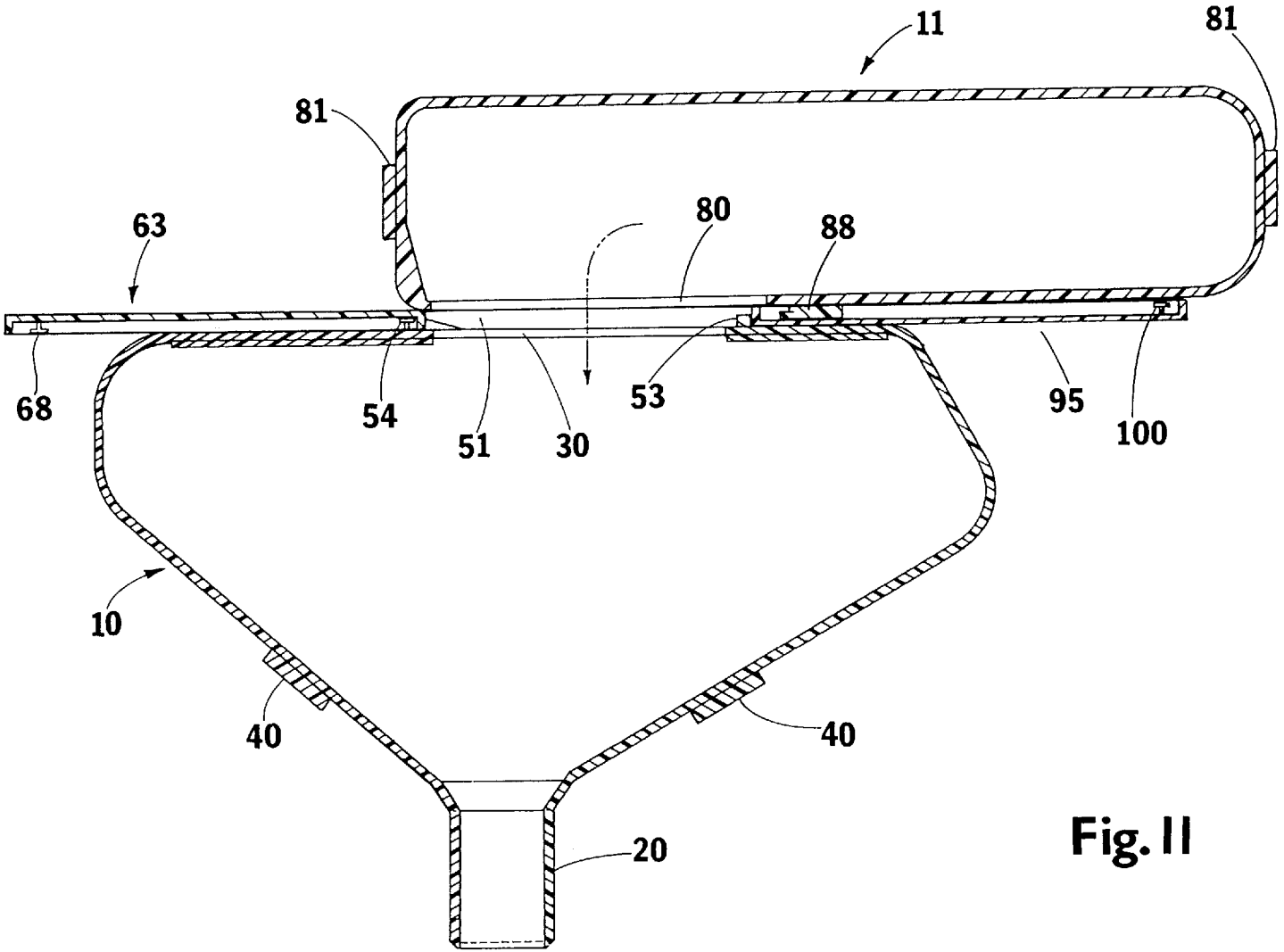
Figure 12:
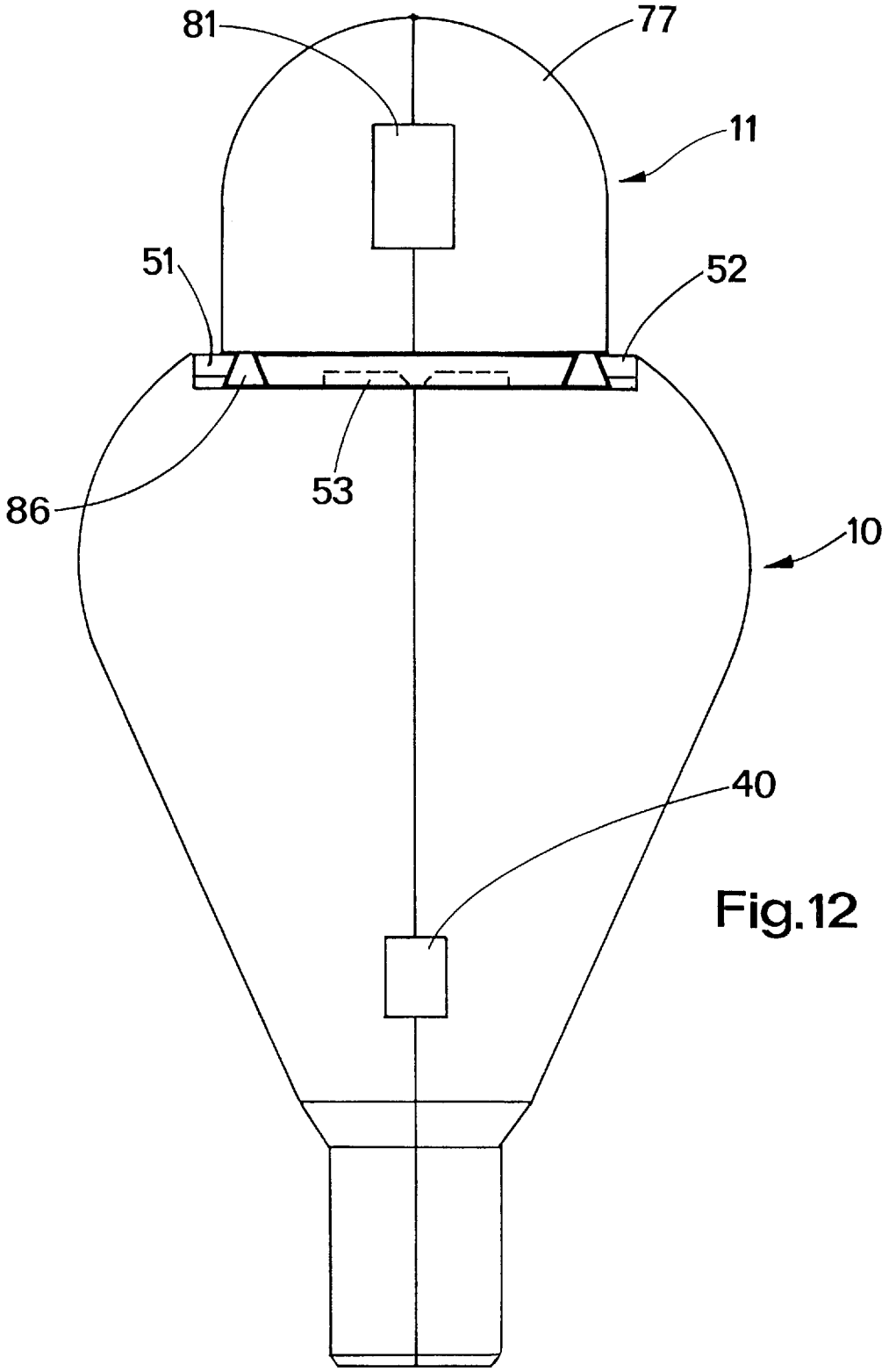

FIG. 9*a* is a perspective or assembly view of the hopper of FIGS. 1–4*b* with the hopper gate removed and elevated away from the hopper for clarity and with the rubber band shown in dashed lines;

FIG. 9*b* is a perspective or assembly view of the loader of FIGS. 5–8*d* with the loader gate removed and elevated away from the loader for clarity and with the rubber band shown in dashed lines;

FIG. 10 is a sectional view of the loader just prior to engaging the hopper;

FIG. 11 is the same side sectional view as in FIG. 10 except the loader is completely engaged with the hopper whereby both the loader and hopper gates are open thereby defining a mouth for the new paintballs to fall or roll from the loader into the hopper; and FIG. 12 is an end elevational view of the loader completely engaged on the hopper as shown in FIG. 11.

Similar numerals refer to similar parts throughout the drawings.

A DETAILED DESCRIPTION OF THE PREFERRED EMBODIMENT

The improved loader and hopper for paintball gun applications of the present invention principally comprises two separate components; namely a hopper 10 and a loader 11.

The hopper 10 is designed to hold approximately two hundred (200) paintballs and is attached to a paintball gun (not shown) using a standard elbow adaptor (not shown) specific to the gun model on the gun end and specific to the standard size of the hopper neck 20 on the other end. (see FIG. 1 to see the hopper neck) The elbow is usually supplied by others and is not part of this application. The loaders 11 are designed to hold approximately one hundred (100) paintballs and fit into the standard loader tube carrying packs (the carrying packs are not part of this application).

Many of the components of the present invention are preferably made of molded plastics. In the preferred embodiment, the plastic is black in color on the standard version, but other color options are available. In the preferred embodiment, the exterior finish is matte to reduce glare.

Figure 2:
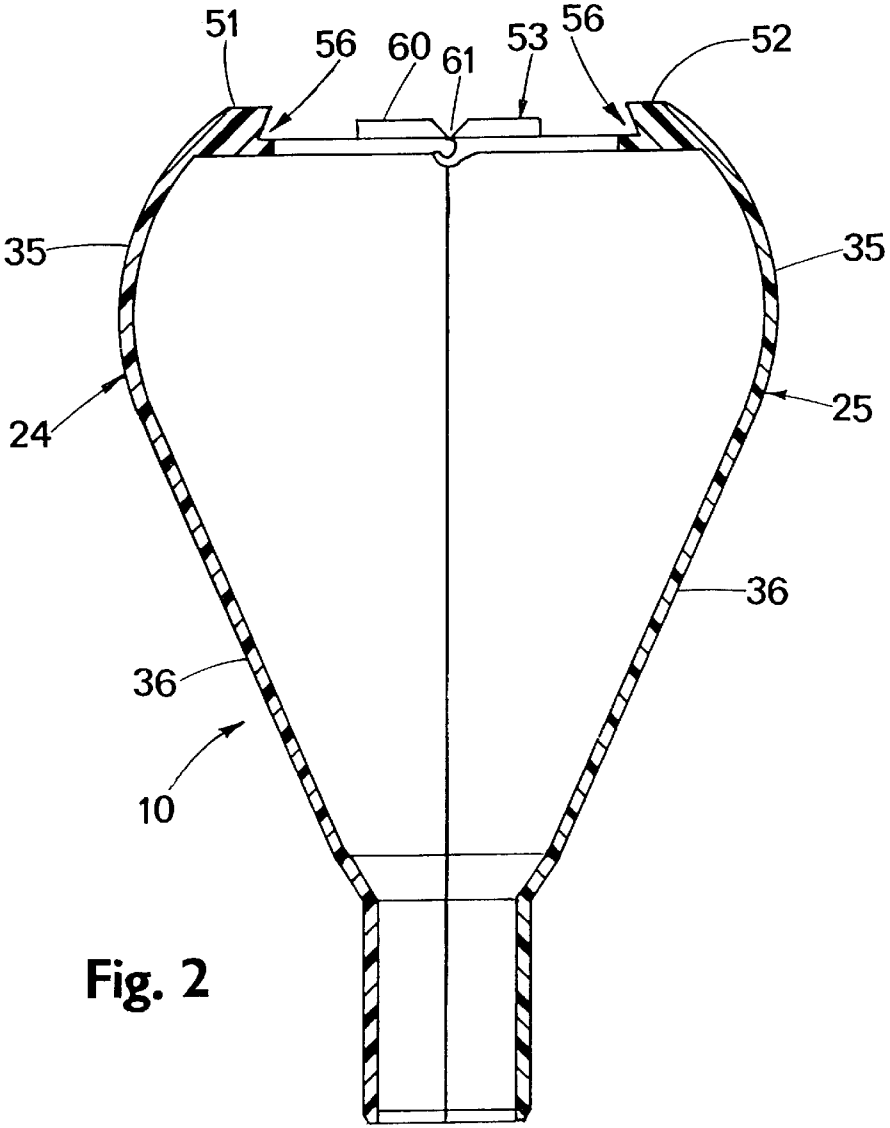

The hopper 10 as best shown in FIGS. 1, 2, 3 and 9*a* is a hollow chamber 21 for holding paintballs prior to loading of each paintball in the firing chamber and then firing of that paintball therefrom. The hopper 10 and its hollow interior chamber 21 are defined by a top wall 22, a front wall 23, a back wall 24, a pair of side walls 25 and 26, and a cylindrical tube which is the hopper neck 20 as defined above. The top wall 22 is relatively planar and includes a hole 30 therein. The front wall 23, back wall 24, and side walls 25 and 26 are each uniquely shaped so that the cumulation of the four walls defines the unique shape as shown best in FIGS. 1, 2 and 3 where overall the walls 23, 24, 25, and 26 define a generally funnel shape from the top wall 22 to the hopper neck 20 (as is clearly shown in FIG. 1). In more detail, the front wall 23 includes an upper surface 31 and a lower surface 32, where the upper surface 31 actually flares out before the lower surface 32 funnels inward as best shown in FIG. 1. Also in more detail, the back wall 24 includes an upper surface 33 and a lower surface 34, where the upper surface 33 extends downward from the top wall 22 in a substantially perpendicular manner before the lower surface 34 funnels inward as best shown in FIG. 1. Additionally in further detail, the side walls 25 and 26 are substantially arcuate from the top wall 22 to the hopper neck 20 as each includes an upper bulge 35 and a lower surface 36 where the bulge actually initially extends outward from the top wall 22 as shown in FIG. 2 before turning inward and transitioning into lower surface 36. Also, all of the transitions from wall to adjacent wall are rounded, such as for instance from the top wall 22 to any of the adjacent front wall 23, back wall 24, and side walls 25 and 26, as well as between each of the adjacent front wall 23 and side walls 25 and 26, and the back wall 24 and the side walls 25 and 26.

In the most preferred embodiment, hopper 10 is a two piece construction although it may alternatively be one piece or three or more. As a two piece construction, the hopper is easily disassembled, cleaned and reassembled as is often necessary when a paintball breaks inside as was described above in the Summary in more detail. The two pieces of hopper 10 are snapped together based upon an edge joint construction as shown in FIG. 1*b*. The seam between the two points may be anywhere desired on the hopper although it is generally preferred that this seam is along the centerline separating the two halves of the hopper where such a centerline splits the hopper 10 as shown in FIG. 2 in half. An assembly hinge 39 is also affixed along this centerline and serves to hold the two pieces together (this hinge being shown in FIGS. 1*c* and 3).

Hopper 10 also includes one or more field snaps 40 (as shown in FIGS. 1, 1*a* and 2). Each field snap is of the configuration shown in FIG. 1 a where it extends outward from the hopper body as a field snap body 41 and an extension 42 therefrom. The outermost portion 43 of the extension 42 of field snap 40 is rounded or radiused at 44 and includes a sloped outer face 45. The field snap 40 also includes a lower lip 46 defining a notch 47 at the base of the extension 42. The field snap also includes a slot 48 in the body as shown in FIG. 1*a*. The field snaps 40 engage a lip, ridge, lock, hook, or other appendage 49 that extends outward from an adjacent part of the hopper and includes lips 49A and 49B so as to allow the field snap 40 on one half to lock or secure to the appendage 49 on the other half thereby holding the hopper together.

Figure 3:
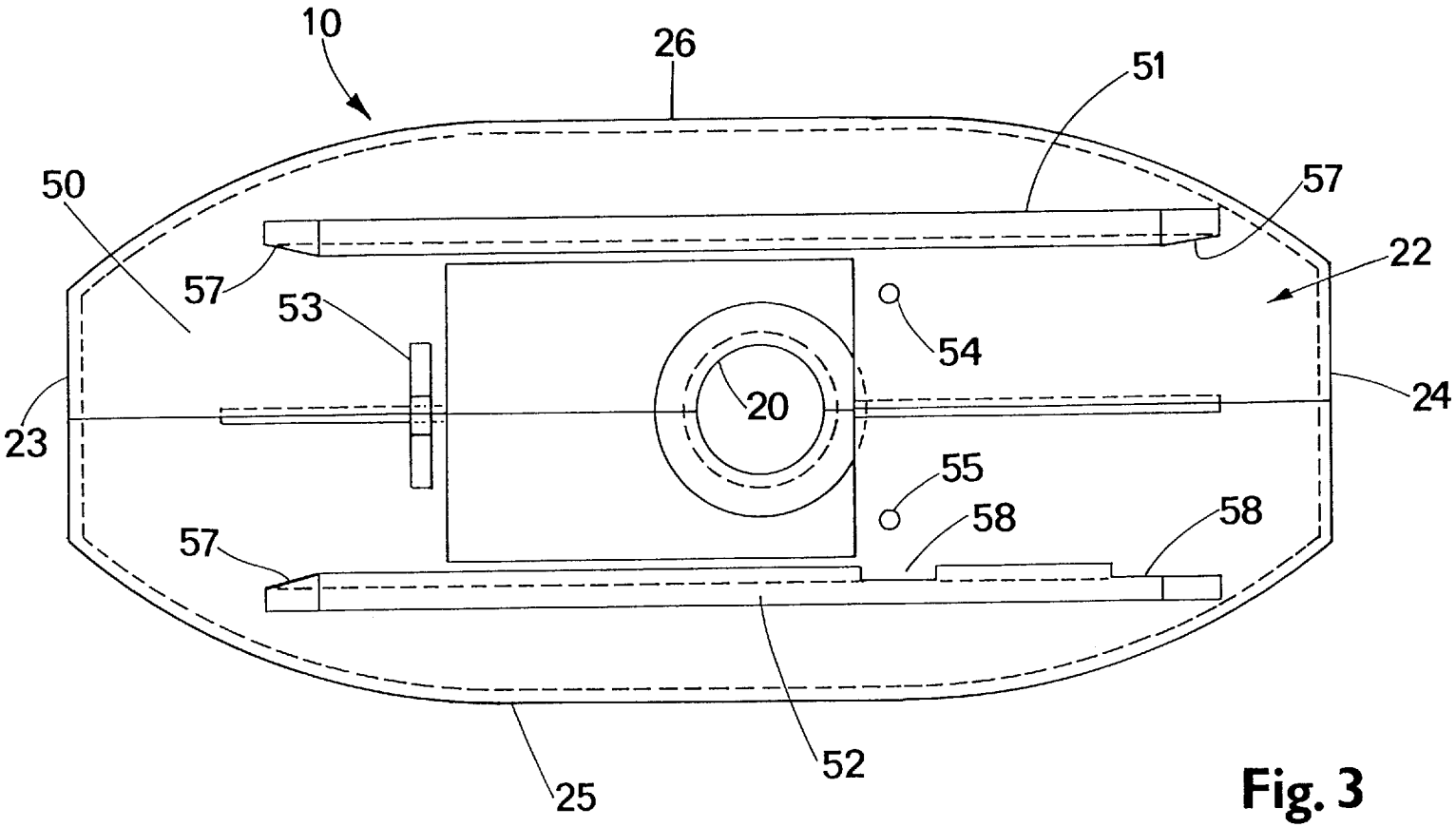
FIG. 3 is a top plan view of the hopper of FIG. 1 with the hopper gate not shown and with hidden parts shown in hidden lines.

The top wall 22 includes a flat planar region 50 with a pair of spaced apart and substantially parallel rails 51 and 52 defining two edges of the flat planar region as shown in FIGS. 2, 2*a*, and 3. The top wall 22 further includes a gate stop 53 and a pair of nubs 54 and 55 as best shown in FIGS. 1, 2, and 3.

Rails 51 and 52 are elongated bodies, both of which combine to define a dove-tail groove 56, as best shown in FIG. 2, in which the hopper gate as later described and the loader slide. This dove-tail groove 56 functions to prohibit the hopper gate from being removed except via sliding out the ends of the rails. The rails further include angled ends 57. The rails also include cut-outs 58 to assist in the insertion of the hopper gate during assembly.

Gate stop 53 is best shown in FIGS. 2 and 2*a* as a barrier 60 with triangular cut-out 61 therein. The pair of nubs 54 and 55 are best shown in FIGS. 1 and 3 where each is a protrusion outward from the flat planar top 22.

Hopper 10 further includes a hopper gate 63 which is a lid, cap, gate or other cover constructed as best shown in FIG. 4. Hopper gate 63 is a flat, planar gate with a peripheral lip 64 therearound as shown in FIGS. 4 and 4*b* where the outer surface 65 of the lip 64 flares outward in a configuration that complements the dove-tail design of groove 56. The flared lip has a notch 66 therein to assist in the engagement of the hopper gate 63 to the hopper 10. The lip 64 also defines a cavity 67 with a round headed push pin 68 therein which has a cylindrical neck and a round head as best shown in FIG. 4*b*.

The hopper 10 with hopper gate 63 is best shown assembled in FIG. 9*a*. A rubber band 70 holds the gate 63 in place on the hopper 10 but allows for the gate to be forcibly slid to uncover hole 30 thereby providing access to the chamber 21 therein. The rubber band 70 is a biasing means for holding the gate 63 in a closed position over the hole 30. The rubber band 70 wraps around nubs 54 and 55 on the hopper 10 and also around push pin 68 of the hopper gate 63. The rubber band biases the gate 63 in the rails 51 and 52 such that the hopper gate rests against the gate stop 53. However, the hole 30 is uncovered by forcing the hopper gate 63 to slide away from gate stop 53 thereby overcoming the rubber band bias and stretching the flexible rubber band 70; however when such force is removed the rubber band 70 snaps the gate back into the closed position. The hopper gate 63 can be removed from the hopper 10 by sliding the gate away from the gate stop until the assembly slots or cut-outs 58 and the rail portion therearound align with the flared lip 64 and notch 66 in the gate respectively thereby allowing the gate 63 to be transversely pulled away from the hopper 10.

The other major component of the present invention is the loader 11. Loader 11 is best shown in FIGS. 5, 6, 7, 8, 8*a*, 8*b*, 8*c*, 8*d* and 9*b*. Loader 11 as best shown in FIGS. 5, 6 and 9*b* is a hollow chamber 75 for holding extra paintballs that are to be loaded at some point into the hopper 10 to replenish the hopper.

The loader 11 and its hollow interior chamber 75 are defined by a bottom wall 76, an arcuate other wall 77, and a pair of end walls 78 and 79. The bottom wall 76 is relatively planar and includes a hole 80 therein. The arcuate other wall is approximately an arcuate wall bent such that a section view of the wall shows it as a semi-cylindrical curve as shown in FIG. 9*b*. The end walls 78 and 79 are substantially semi-cylindrical as best shown in FIGS. 7 and 9*b*. Also, the transitions from end walls 78 and 79 to the adjacent either bottom wall 76 or arcuate other wall 77 are rounded.

In the most preferred embodiment, loader 11 is a two piece construction although it may alternatively be one piece or three or more. As a two piece construction, the loader is easily disassembled, cleaned and reassembled as is often necessary when a paintball breaks inside as was described above in the Summary in more detail. The two pieces of loader 11 are snapped together based upon an edge joint construction as shown in FIG. 1*b*. The seam between the two points may be anywhere desired on the loader although it is generally preferred that this seam is along the centerline separating the two halves of the loader where such a centerline splits the loader 11 as shown in FIG. 6 in half.

The loader 11 also includes field snaps 81 and hooks 82 of substantially similar or identical construction to that described above for the hopper. These field snaps and hooks serve to hold the multiple piece loader together while allowing for easy and quick disassembly, cleaning, and reassembly when a paintball has contaminated the inside.

The bottom wall 76 of loader 11 includes a flat planar region 85 with a pair of spaced apart and substantially parallel rails 86 and 87 defining two edges of the flat planar region as shown in FIGS. 5, 6, 7 and 9*b*. The bottom wall 76 further includes a gate stop 88 as best shown in FIGS. 5, 6, 8*b* and 9*b*.

Rails 86 and 87 are elongated bodies, both of which have an inner surface 91A that slopes whereby the slopes combine to define a dove-tail groove 89, as best shown in FIGS. 7 and 9*b*, in which the loader gate as later described. This dove-tail groove 89 functions to prohibit the loader gate from being removed except via sliding out the ends of the rails. The rails further include angled ends similar to those of the hopper, all of which assist in the sliding assembly of the apparatus. The rails also include cut-outs 90 to assist in the insertion of the hopper gate during assembly.

The rails 86 and 87 also include a sloped outer surface 91B opposing the sloped inner surface 91A on each rail that defines the dove-tail groove. This in effect makes the cross section of each rail 86 and 87 of a trapezoidal shape as best shown in FIGS. 7 and 9*b*.

Gate stop 88 as best shown in FIGS. 8*b* and 8*c*, is a hook-like stop extending outward from bottom wall 76 where the hook-like stop includes a neck portion 92 and a head portion 93 that is of the same dimensions except for along one edge where the head portion extends or is larger so as to define a lip 94.

Loader 11 further includes a loader gate 95 which is a lid, cap, gate or other cover constructed as best shown in FIGS. 8 and 8*d*. Loader gate 95 is a flat, planar gate with a peripheral lip 96 therearound as shown in FIGS. 8 and 8*d* where the outer surface 97 of the lip 96 flares outward in a manner complementary to the dove-tail of the groove 89. The flared lip has a notch 98 therein to assist in the engagement of the loader gate 95 to the loader 11. The lip 96 also defines a cavity 99 with a pair of nubs 100 and 101 therein as best shown in FIG. 8.

The loader 11 with loader gate 95 is best shown assembled in FIG. 9*b*. A rubber band 105 holds the gate 95 in place on the loader 11 but allows for the gate to be forcibly slid to uncover hole 80 thereby providing access to the chamber 75 therein. The rubber band 105 is a biasing means for holding the gate 95 in a closed position over the hole 80. The rubber band 105 wraps around nubs 100 and 101 on the loader gate 95 and also around gate stop 88. The rubber band biases the gate 95 in the rails 86 and 87 such that the loader gate rests against the gate stop 88. However, the hole 80 is uncovered by forcing the loader gate 95 to slide away from gate stop 88 thereby overcoming the rubber band bias and stretching the flexible rubber band 105; however when such force is removed the rubber band 105 snaps the gate back into the closed position. The loader gate 95 can be removed from the loader 11 by sliding the gate away from the gate stop until the assembly slots or cut-outs 90 and the rail portion therearound align with the flared lip 96 and notch 98 in the gate respectively thereby allowing the gate 95 to be transversely pulled away from the loader 11.

The present invention further includes the feature of aligning the loader 11 so as to seat on the hopper 10. FIGS. 10 and 11 show this sequence. As will be described in more detail below, the rails 86 and 87 on the loader 11 and the rails 51 and 52 on the hopper 10 are aligned such that pushing of the loader causes the loader to slide within the rails 51 and 52 of the hopper thereby causing the gates to move.

One of the principal features of the invention is the 'rails' that guide the two main components, namely the hopper 10 and the loader 11, together. These rails are 22.5 degree bevels molded into the main body of the components (the hopper and loader) as described above, (see FIG. 2, FIG. 7, FIG. 9*a* and FIG. 9*b*) and align one inside the other when engaged. Specifically, in accordance with one of the main features of the invention, the rails 86 and 87 of loader 11 slide within the rails 51 and 52 of hopper 10 as is shown from FIGS. 10 to 11. This secures the loader 11 to the hopper 10 during the transfer of paintballs from the loader to the hopper during a refill of the hopper.

Another of the principal features of the invention is the automatic opening of the gates (hopper gate 63 and loader gate 95 which close the hopper 10 and loader 12) when the hopper and loader are slid together along these rails. Basically, when loader 11 slides into rails 51 and 52 of the hopper 10, the rails 86 and 87 push the hopper gate 63 open (as the loader rails 86 and 87 are closer together than the hopper rails 51 and 52 so as to fit between the hopper rails and to engage the hopper gate 63).

The unique design of these automatically operating hopper and loader gates 63 and 95 is made possible by the use of a simple rubber band located under each of the gates and attached to the body of the respective component for biasing the gates closed. However, this bias is overcome during loading as described below so as to allow the gates 63 and 95 to open thereby aligning the holes 30 and 80 to allow paintballs to pass from the loader to the hopper.

The gates are operated by a gate stop 53 that engages the leading edge of the loader gate 95 and pushes it open while the 'rails' 86 and 87 on the speed loader 11 engage the hopper gate 63 and push it open, thus dumping the full load of paintballs into the hopper mouth as defined as the alignment of the holes 30 and 80. (see FIG. 2*a* and FIG. 8*b*) The rubber bands 70 and 105 are stretched during this gate opening in which the mouth is defined. The rubber band 70 stretches around nubs 54 and 55 and push pin 68, while rubber band 105 stretches around nubs 100 and 101 and gate stop 88.

However, there is sufficient tension on the rubber bands to hold the gates in the closed position when the gates are not otherwise urged to overcome the rubber band bias. When the components are engaged properly the rubber bands will stretch then return the gate to its original position when the components are disengaged. This design makes it simple and easy to operate and repair.

There are slots or notches 66 and 98 designed into the hopper and speed loader gates that allow easy assembly, disassembly and easy access to the rubber bands when properly aligned. (see FIG. 3 and FIG. 4)

There are 'field snaps' 40 and 81 located periodically around the edge joint on the hopper and the loader. They allow the hopper body and the loader body to be opened without the use of tools. Simply push the snaps with your thumb and unlock the separate halves of the hopper allowing it to open and be cleaned in the field when necessary. (See FIG. 1 and FIG. 1*a*)

The slender profile of the hopper body is an advantage when used in tournament play by providing a smaller target since if a paintball hits even a player's equipment this will eliminate the player from the game. (see FIG. 1 and FIG. 2)

The logo areas are located on the sides and toward the leading edge of the speed loader to help orient the alignment with the hopper. The hopper logo is located on the plan view of the hopper gate. (see FIG. 5 and FIG. 9)

The trailing end of the speed loader is rounded to make it easier to slip it into its pack.(see FIG. 5)

The edge joints (where the two halves of the components butt together) overlap to provide a good fit and some added protection from the elements.(see FIG. 1*b* and FIG. 1*c*) As is clearly shown in the FIG. 1*b*, the preferred embodiment of the edge joint is a tongue and groove configuration as shown at B.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved paintball loader and paintball hopper is constructed and used, the characteristics of the construction, and the advantageous, new and useful results obtained; the new and useful structures, devices, elements, arrangements, parts and combinations, are set forth in the appended claims.

I claim:

1. An improved paintball loading mechanism for use in the sport of paintball where paintballs are fired from a gun attachable and usable with the paintball loading mechanism, the improved paintball loading mechanism comprising:

a hopper for storing paintballs prior to firing of the paintballs, the hopper having a paintball fill hole therein;

a hopper gate biased closed over the paintball fill hole;

a loader for storing additional paintballs for use in refilling the hopper as needed, the loader having a paintball exit hole, and the loader being selectively engageable with the hopper so as to allow alignment of the paintball fill hole with the paintball exit hole so that paintballs within the loader may pass into the hopper; and a loader gate biased closed over the paintball exit hole, where the selective engagement of the loader with the hopper causes the hopper gate and loader gate to be biased out of closure over the paintball fill hole and the paintball exit hole respectively.

2. The improved paintball loading mechanism of claim 1 wherein the hopper includes a hopper body having a pair of hopper rails extending therefrom and spaced apart from one another on opposing sides of the paintball fill hole.

3. The improved paintball loading mechanism of claim 2 wherein the loader includes a loader body having a pair of loader rails extending therefrom and spaced apart from one another on opposing sides of the paintball exit hole.

4. The improved paintball loading mechanism of claim 3 wherein the hopper rails are substantially parallel to one another, the loader rails are substantially parallel to one another, and the loader rails are spaced apart from each other a distance less than the distance the hopper rails are spaced apart from one another.

5. The improved paintball loading mechanism of claim 4 wherein the loader rails fit in between the hopper rails.

6. The improved paintball loading mechanism of claim 5 wherein the loader rails and the hopper rails each have at least one tapered surface.

7. The improved paintball loading mechanism of claim 5 wherein each loader rail is of a dove-tailed cross-section with the rail being narrow proximate the loader body and widening distally away from the loader.

8. The improved paintball loading mechanism of claim 7 wherein the hopper rails each include an inner surface of a tapered configuration.

9. The improved paintball loading mechanism of claim 8 wherein the inner surfaces of each of the hopper rails define a hopper dove-tail that receives the loader rails when the loader is engaged within the hopper.

10. The improved paintball loading mechanism of claim 1 wherein the hopper includes a gate stop for opening the loader gate when the loader engages the hopper, and the loader includes a gate stop for stopping further engaging of the loader onto the hopper.

11. The improved paintball loading mechanism of claim 1 wherein the hopper gate is biased by a rubber band that stretches around a pair of nubs on the hopper and a push pin on the hopper gate, while the loader gate is biased by a rubber band that stretches around a second pair of nubs on the loader gate and a gate stop on the loader.

12. The improved paintball loading mechanism of claim 1 wherein at least one of the hopper and the loader is of a two piece construction of a tongue and groove nature.

13. An improved paintball loading mechanism for use in the sport of paintball, the paintball loading mechanism comprising:

a hopper for housing a plurality of paintballs prior to firing, the hopper being attachable to a paintball gun;

a chamber for housing a replenishing plurality of paintballs; and means for engaging the chamber with the hopper and simultaneously opening a passage for the replenishing plurality of paintballs to pass into the hopper.

14. The improved paintball loading mechanism of claim 13 wherein the means for engaging and providing includes a hopper gate biased into a closed position over a hopper hole and a chamber gate biased into a closed position over a chamber hole where the holes are selectively alienable to define the passage by urging the chamber into engagement with the hopper.

15. The improved paintball loading mechanism of claim 14 wherein the chamber includes a pair of chamber rails and the hopper includes a pair of hopper rails slidable within the chamber rails when the chamber is urged into engagement with the hopper.

16. A method of reloading paintballs into a paintball gun, the method comprising the following steps:

sliding a loader having a plurality of paintballs therein into engagement with a hopper on the paintball gun; and substantially simultaneously with the sliding, opening of a loader gate covering a paintball exit hole in the loader and a hopper gate covering a paintball fill hole.

17. The method of claim 16 wherein the sliding of the loader urges the hopper gate open.

18. The method of claim 17 wherein a gate stop on the hopper stops sliding of the loader gate while the loader continues sliding thereby opening the loader gate.

19. The method of claim 18 wherein the sliding of the loader into engagement with the hopper includes the aligning of a pair of rails on the loader in between a pair of rails on the hopper.

20. The method of claim 19 wherein the loader rails dove-tail fit into the hopper rails.

* * * * *